United States Patent [19]

Kosova

[11] Patent Number: 4,492,046

[45] Date of Patent: Jan. 8, 1985

[54] RUNNING SHOE

[76] Inventor: Ghenz Kosova, 100 NW. Second Ave., Boca Raton, Fla. 33432

[21] Appl. No.: 500,242

[22] Filed: Jun. 1, 1983

[51] Int. Cl.[3] ..... A43B 13/28

[52] U.S. Cl. ..... 36/27; 36/38

[58] Field of Search ..... 36/83, 103, 105, 114, 36/129, 27, 38, 7.8

[56] References Cited

U.S. PATENT DOCUMENTS

| | | | |
|---|---|---|---|
| 676,267 | 1/1899 | Goldberg . | |
| 1,726,028 | 8/1929 | Keller | 36/7.8 |
| 2,447,603 | 8/1948 | Snyder | 36/38 |
| 2,508,318 | 5/1950 | Wallach | 36/38 |
| 3,251,144 | 5/1966 | Weitzner | 36/2.5 |
| 3,822,490 | 7/1974 | Murawski | 36/105 |
| 3,886,674 | 6/1975 | Pavia | 36/38 |
| 3,902,260 | 9/1975 | Massella et al. | 36/38 X |
| 4,030,213 | 6/1977 | Daswick | 36/30 |
| 4,262,433 | 4/1981 | Hagg et al. | 36/25 R |
| 4,314,413 | 2/1982 | Dassler | 36/129 |
| 4,360,978 | 11/1982 | Simpkins | 36/114 |

FOREIGN PATENT DOCUMENTS

| | | | |
|---|---|---|---|
| 69231 | 5/1949 | Denmark | 36/38 |
| 68962 | 12/1914 | Fed. Rep. of Germany | 36/38 |
| 491842 | 6/1928 | Fed. Rep. of Germany | 36/135 |
| 591740 | 8/1947 | United Kingdom | 36/38 |

*Primary Examiner*—Henry S. Jaudon
*Assistant Examiner*—Tracy G. Graveline
*Attorney, Agent, or Firm*—Oltman and Flynn

[57] ABSTRACT

A running shoe has a longitudinal slot in the sole extending from its back edge into the arch region and dividing the shoe sole into upper and lower segments. A spring wire in this slot decreases the velocity of the heel impact and then, as the runner's weight shifts forward onto the ball and toes of the foot, launches the runner into a comfortable stride and reduces stress.

14 Claims, 8 Drawing Figures

RUNNING SHOE

SUMMARY OF THE INVENTION

This invention relates to a running shoe.

Joggers and distance runners frequently develop foot or leg troubles, often due to the impact of the heel hitting the ground. The weight then shifts from the heel to the ball of the foot with negligible impact absorption occurring throughout the longitudinal arch of the foot. The present invention is directed to a novel shoe which greatly alleviates these problems and improves the runner's performance.

In accordance with this invention, the sole of a running shoe has a longitudinal slot extending across its full width and running from the back of the shoe forward into the arch region. A wire spring of novel design engages the upper and lower sections of the shoe sole above and below this slot and it biases them apart. This spring resiliently cushions the runner's heel as it comes down and then, as the runner's weight shifts forward onto the ball of the foot, the spring pushes the upper section of the sole up away from the lower section before the latter leaves the ground, thereby assisting this weight shift from the heel forward across the longitudinal arch, then to the ball of the foot, and finally to the toes.

A principal object of this invention is to provide a running shoe having a novel spring arrangement for protecting the runner's foot and aiding his or her running performance by providing the runner two phases of assistance, as follows:

Phase 1, The braking or compression phase (occurring during spring compression) which significantly decreases the velocity of heel impact, and Phase 2, The propulsion or retraction phase (occurring during spring retraction), which assists and launches the runner into a comfortable stride yet minimizes stress and strain on the feet, ankles, legs, hips and back areas.

Further objects and advantages of this invention will be apparent from the following detailed description of a presently preferred embodiment which is illustrated schematically in the accompanying drawings.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Figure 1:
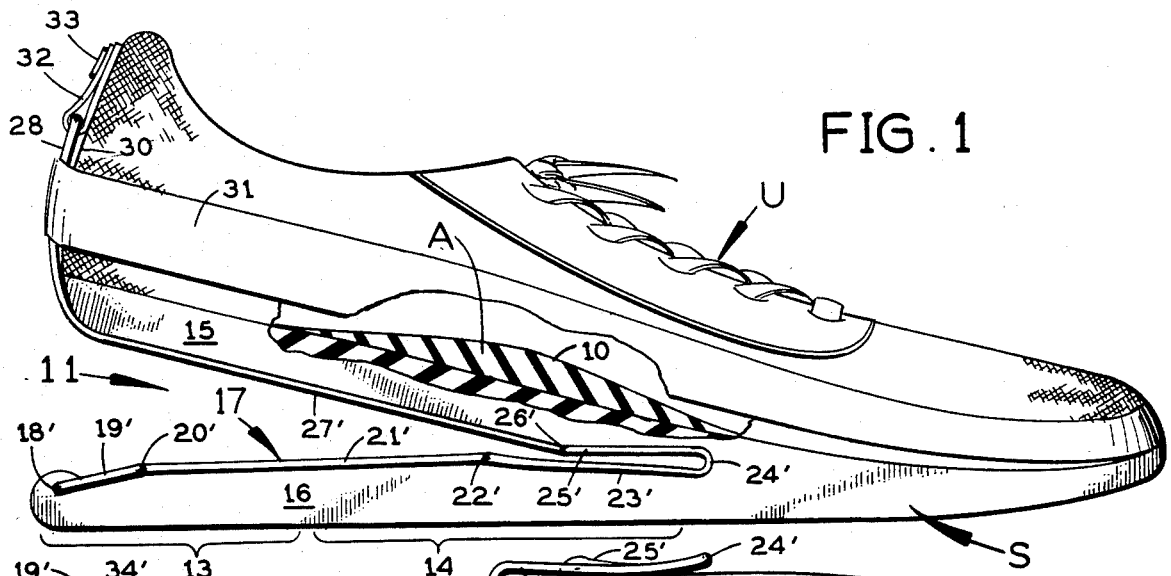
FIG. 1 is a side elevation of the present shoe, with one part broken away for clarity.

Referring to FIG. 1, in the illustrated embodiment the present shoe has an upper U of any suitable design and any suitable material, such as leather or natural or synthetic fabric, or a combination of them. The shoe has a conventional insole (not shown) and a sole S of a known type used in sport shoes, most or all of which is resiliently deformable under the runner's weight. As shown in FIG. 1, a deformable and resilient arch supporting segment A is engaged between the bottom of the insole and the top of the sole S. If desired, this arch support may be formed integral with the sole S. It presents a longitudinally convex top face 10 which fits the curvature of the arch of the runner's foot. Preferably, the apex of curvature of the top face 10 of the arch support A (i.e., its high point) is at the location of the Navicular of the wearer's foot.

The sole S is of progressively increasing vertical thickness from front to back in its toe and ball areas. At the heel and arch areas of the foot, the sole S is at least as thick as in the ball area.

Figure 2:
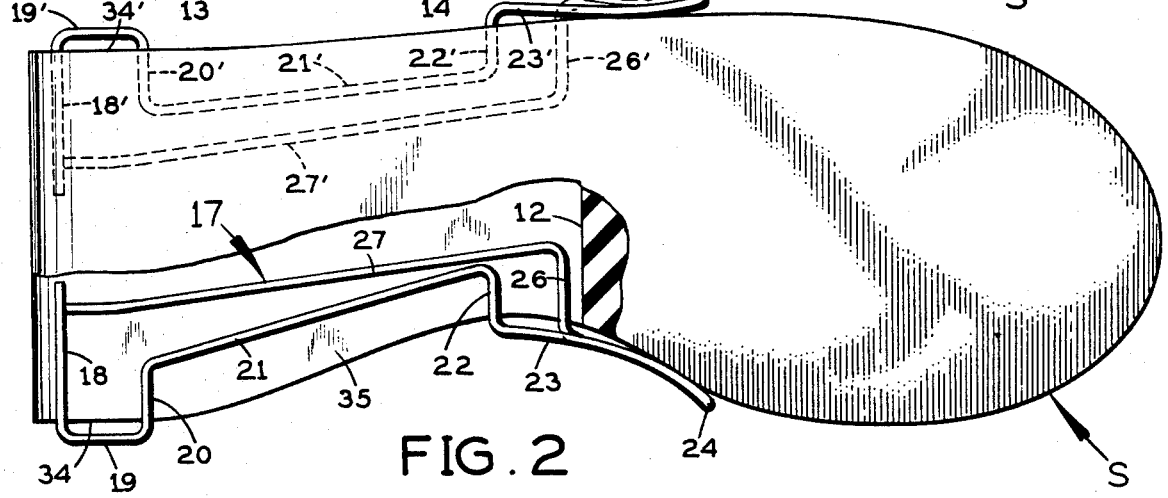
FIG. 2 is a bottom plan view, partly broken away for clarity.
Figure 3:
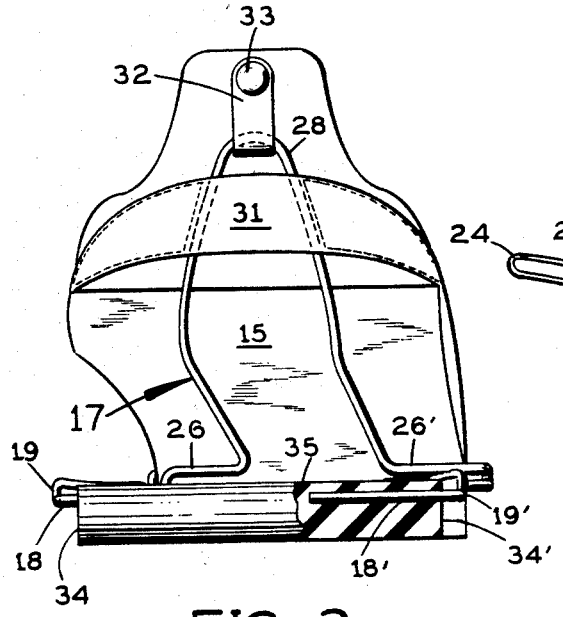
FIG. 3 is a rear elevation, with one part broken away for clarity.

In accordance with the present invention, the sole is formed with a longitudinal slot 11 extending across its complete width from side to side and from the back edge of the shoe to a transverse line 12 (FIG. 2) located beneath the arch support 10 a short distance forward from its high point (at the Navicular). This slot divides the sole S throughout its heel supporting rear segment 13 and for most of its arch-supporing segment 14 into an upper section 15 and a lower section 16. The upper section 15 has a flat bottom face and the lower section 16 has a flat top face 35 (FIGS. 2 and 3).

Figure 4:
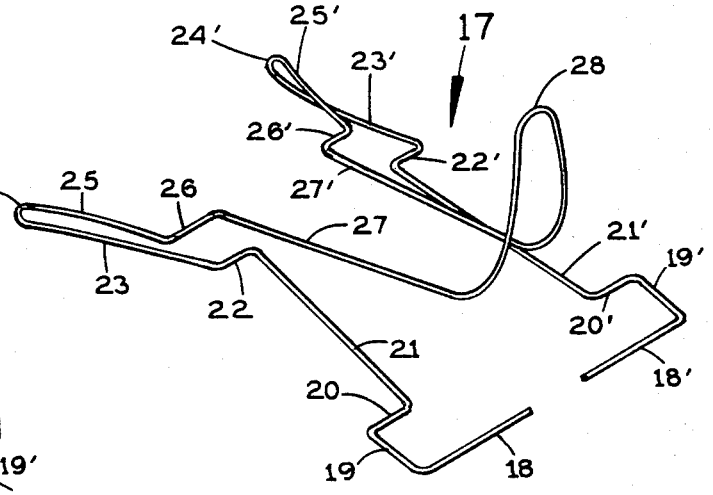
FIG. 4 is a perspective view of the spring in the present shoe.

In accordance with this invention, the slot 11 in the shoe sole receives a spring 17 as shown in FIG. 4. This spring is a one-piece continuous wire of suitable flexible and resilient spring metal having upper and lower halves.

The lower half of the spring has opposite sides, each a mirror image of the other. The left side has a laterally inwardly extending segment 18 at its rear end, a short longitudinal segment 19 extending forward and at a slight angle upward from the outer end of rear segment 18, a short inturned segment 20 extending laterally inward from the front end of longitudinal segment 19 parallel to and slightly above the rear segment 18, a longitudinal segment 21 extending forward and at a slight angle laterally inward from the inner end of segment 20, a short lateral segment 22 extending outward from the front end of longitudinal segment 21 parallel to rear segment 18 and lateral segment 20, and a front longitudinal segment 23 extending forward from the outer end of lateral segment 22. As shown in FIG. 2, the front longitudinal segment 23 is bowed slightly inward so that it has a convex curvature toward the side of the shoe sole. The front end of segment 23 is connected to an upwardly and reversely bent, rounded segment 24 which connects it to the upper half of the spring.

The upper half of the spring on this (the left) side has a front longitudinal segment 25 extending substantially parallel to segment 23 a short distance above the latter. Segment 25 at its rear end is joined to a laterally inwardly extending segment 26 which is located a short distance in front of (and above) the lateral segment 22 of the lower half of the spring. The inner end of lateral segment 26 is joined to a substantial straight, elongated, longitudinal segment 27 extending rearward and at a slight angle laterally inward to one side of the lower end of a bight segment 28 of inverted U-shape.

The right side of the spring is a mirror image of the left side, and its individual segments are given the same reference numerals, with a "prime" suffix added, as those of the left side.

As shown in FIGS. 1 and 3, the bight 28 at the rear end of the upper half of the spring extends up snugly between the back 30 of the shoe upper U and a strap 31 on the outside of the shoe. The upper end of the bight 28 passes through a holder loop 32 of suitable flexible material on the back of the shoe upper U near the top. This holder loop 32 has a snap fastener 33 which can be unfastened to permit the loop to be inserted around the upper end of the bight 28 of the spring, and then fastened to secure these parts together as shown in FIGS. 1 and 3.

The rear end segments 18 and 18' of the lower half of the spring are received snugly in corresponding bores formed in the lower section 16 of the shoe sole a short distance forward from its rear edge. The bore which receives spring segment 18' is shown in FIG. 3. The rear end segments 18 and 18' anchor the lower half of the spring in the lower section 16 of the shoe sole.

The short longitudinal segments 19 and 19' in the opposite sides of the lower half of the spring extend forward and slightly upward along the outside of the respective side faces 34 and 34' of the lower section of the shoe sole, as shown in FIGS. 2 and 3. The inturned segments 20 and 20' of the spring extend closely across the top face 35 of the bottom section 16 of the sole, as do the longitudinal segments 21 and 21' and the lateral segments 22 and 22'. Segments 22 and 22' extend laterally outward past the side edges of the bottom segment 16 of the sole, as shown in FIG. 2. The curved front segments 23 and 23' of the spring bear inwardly against the side edges of the shoe sole forward of the inner edge 12 of slot 11, and these front segments are resiliently deformed outwardly by the sole so that they grip it tightly on opposite sides to securely position the front end of the lower half of the spring on the shoe sole.

In the upper half of the spring the curved front segments 25 and 25' similarly bear tightly against the respective adjacent side edges of the shoe sole forwardly of the inner edge 12 of slot 11. The lateral segments 26 and 26' extend laterally inward in direct engagement with the flat bottom face of the upper section 15 of the shoe sole a very short distance behind the front end 12 of the longitudinal slot 11 in the shoe sole. The longitudinal segments 27 and 27' engage the upper segment 15 of the sole from below from the lateral spring segments 26 and 26' to the back of the shoe, where the upwardly projecting bight 28 of the spring is located.

The inherent spring bias of the spring causes its upper half to extend upward and rearward from its lower half. Consequently, when positioned on the shoe, the spring biases the upper section 15 of the shoe sole upward from the lower section 16, as shown in FIG. 1, with the hinge axis between these sections of the shoe sole being located in the vicinity of the inner end 12 of slot 11 (FIG. 2).

FIGS. 5–8 show how the spring 17 performs in the shoe.

Figure 5:
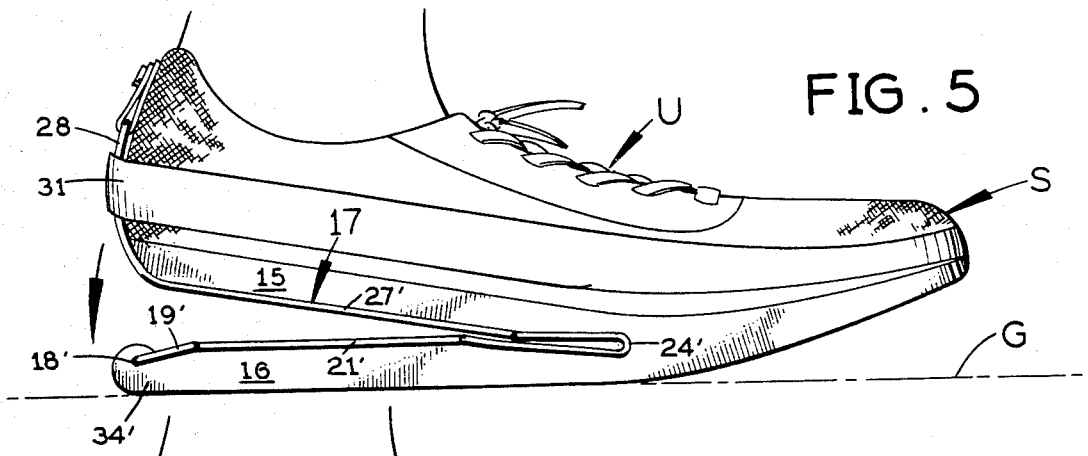
FIG. 5 is a side elevation showing the shoe when the runner's weight is coming down on the heel and velocity absorption occurs due to the spring.
Figure 6:
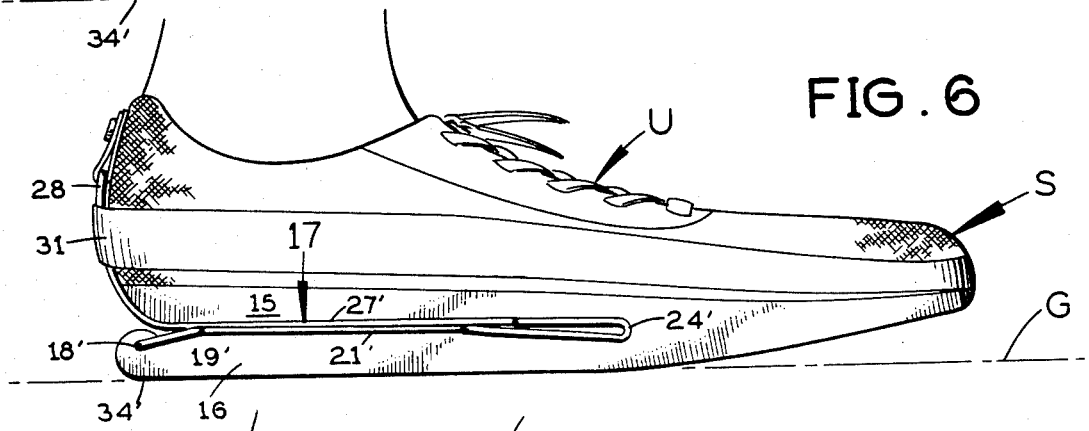
FIG. 6 is a similar view showing the shoe when the runner's weight is completely down on the heel.
Figure 7:
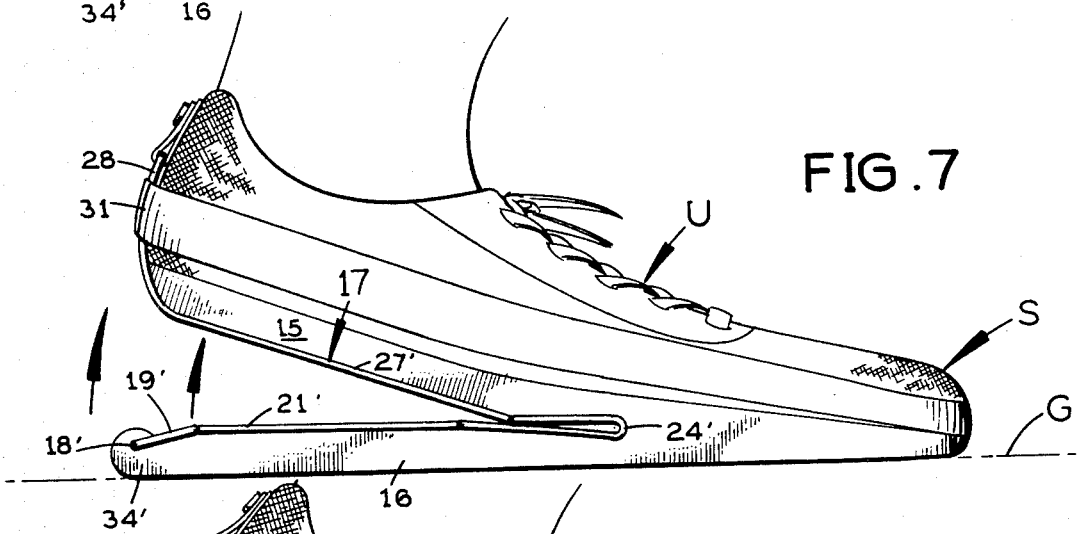
FIG. 7 is a similar view showing the shoe when the runner's weight is shifted to the ball of the foot and propulsion occurs, also due to the spring.

As shown in FIG. 5, when the runner's foot first lands, his or her weight will come down on the heel, causing the upper section 15 of the sole at the heel to come down on the lower section 16, which is engaging the ground G. This causes the upper half of the spring 17 to come down to the position shown in FIG. 6, in which the longitudinal segments 27 and 27' in the upper half of the spring are substantially coplanar with segments 21 and 21' in its lower half. The inherent bias of the spring opposes this downward displacement of its upper half as the runner's heel comes down, so the spring decreases the velocity of the heel's impact. This is the braking or compression phase of the spring's operation.

Figure 8:
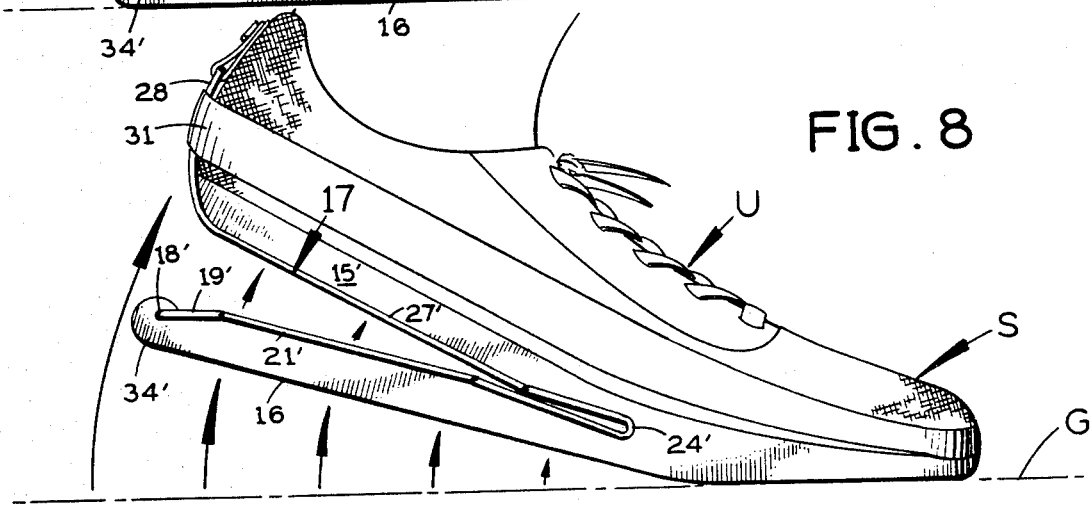
FIG. 8 is a similar view of the shoe with the runner's weight all the way forward on the toes.

As the runner's weight shifts forward onto the ball of this foot (FIG. 7), the spring can expand again with a catapult-like action, with its upper half moving upward from its lower half and assisting the runner's natural tendency to shift this weight from the heel (FIG. 6) forward across the longitudinal arch of the foot, then to the ball of the foot (FIG. 7), and finally the toes (FIG. 8). This is the spring propulsion or retraction phase, during which the spring expands to the shape dictated by its preformed spring bias. During this phase the spring, in effect, launches the runner into a comfortable stride and minimizes stess and strain on the feet, ankles, legs, hips and back areas. When the runner's weight has been shifted forward onto his toes, the lower section 16 of the shoe sole will move up from engagement with the ground, as shown in FIG. 8, because the spring 17 couples the lower section 16 to the upper section 15, and it pulls the lower section up from the ground as soon as the runner's foot reaches a certain point during the forward shift of the runner's weight.

It will be apparent that the lower half of the spring moves in unison with the lower section 16 of the shoe sole whereas the upper half of the spring moves down toward and up away from it. The upper half of the spring acts as a springboard pivoted at its front end. The lower half of the spring acts as a base for this springboard, in effect anchoring its pivoted front end to the lower section 16 of the shoe sole while permitting the rest of the this "springboard" (i.e., the upper half of the spring) to move up and down with respect to the lower section 16 of the shoe sole. When this "springboard" moves down toward the lower section of the shoe it reduces this downward velocity of the heel and diminishes its impact, as well as storing energy. When the runner's weight shifts from the heel, this stored energy in the spring produces a catapult-like upward movement of the upper half of the spring.

I claim:

1. In a sole for a running shoe having a sole body of deformable resilient material with:

a heel-supporting rear segment with top and bottom faces;

an arch-supporting middle segment extending forward from said rear segment; and a ball and toe-supporting front segment extending forward from said middle segment;

said rear segment having a longitudinal slot extending forward from its rear edge between said top and bottom faces across its complete width and separating said rear segment of the sole body into upper and lower sections;

the improvement which comprises:

a spring wire received in said slot and having an upper half engaging said upper section of said rear segment of the sole body and a lower half engaging said lower section of said rear segment of the sole body, said upper and lower halves of said spring wire being flexibly and resiliently connected to each other at the front end to bias said upper half of the spring wire upward from its lower half toward the rear of the shoe sole and permit up and down movement of said upper half of the spring wire away from and toward said lower section of said rear segment of the shoe sole;

said upper and lower halves of the spring wire being flexibly and resiliently connected to each other forward beyond said slot along the opposite sides of said middle segment of the shoe sole.

2. A running shoe sole according to claim 1, wherein:

said lower half of the spring wire comprises a pair of laterally spaced arms extending across the top of said lower section of said rear segment of the sole body lengthwise of said slot from back to front and then laterally outward to the side edges of the sole body at its middle segment and then forward along those side edges to a front end located at said middle segment of the sole body; and said upper half of the spring wire comprises a pair of laterally spaced arms respectively joined integrally to the arms of said lower half of the spring wire at its front end and extending rearward along the side edges of the sole body and then laterally inward into said slot and then rearward beneath the bottom of said upper section of said rear segment of the sole body.

3. A running shoe sole according to claim 2, and further comprising:

anchoring segments on the rear ends of said arms of the lower half of the spring wire for anchoring them to said lower section of said rear segment of the sole body.

4. A running shoe sole according to claim 2 wherein:

each of said laterally spaced arms of said lower half of the spring wire at its back end extends laterally outward to the nearer side edge of said lower section of said rear segment of the sole body and then rearward and downward across that side edge and then laterally inward into said lower section.

5. A running shoe according to claim 2 wherein:

said upper half of the spring wire at its rear end has an upwardly extending bight segment connecting and extending laterally between its laterally spaced arms for attachment to the back of the shoe upper.

6. A running shoe according to claim 2, wherein:

said arms of the upper and lower halves of the spring wire resiliently grip the side edges of the sole body forward beyond said slot.

7. A running shoe sole according to claim 2 wherein:

each of said laterally spaced arms of said lower half of the spring wire at its back end extends laterally outward to the nearer side edge of said lower section of said rear segment of the sole body and then rearward and downward across that side edge and then laterally inward into said lower section;

said upper half of the spring wire at its rear end has an upwardly extending bight segment connecting and extending laterally between its laterally spaced arms for attachment to the back of the shoe upper; and said arms of the upper and lower halves of the spring wire resiliently grip the side edges of the sole body forward beyond said slot.

8. In a running shoe having a shoe upper and a sole body of deformable resilient material attached to said upper and having:

a heel-supporting rear segment with top and bottom faces;

an arch-supporting middle segment extending forward from said rear segment; and a ball and toe-supporting front segment extending forward from said middle segment;

said rear segment having a longitudinal slot extending forward from its rear edge between said top and bottom faces across its complete width and separating said rear segment of the sole body into upper and lower sections;

the improvement which comprises:

a spring wire received in said slot and having an upper half engaging said upper section of said rear segment of the sole body and a lower half engaging said lower section of said rear segment of the sole body, said upper and lower halves of said spring wire being flexibly and resiliently connected to each other at the front end to bias said upper half of the spring wire upward from its lower half toward the rear of the shoe sole and permit up and down movement of said upper half of the spring wire away from and toward said lower section of said rear segment of the shoe sole; and retainer means on said shoe upper at the back of the shoe for engagement with said upper half of the spring wire to attach the latter to the shoe upper;

said upper half of the spring wire at its rear end presenting an upwardly extending segment which extends up behind said upper section of said rear segment of the sole body and closely behind the back of said shoe upper; and said retainer means including a flexible flap forming a loop which is held closed by a fastener and which receives the upper end of said upwardly extending segment of the upper half of the spring.

9. A running shoe according to claim 8, wherein:

said retainer means also includes a strap on the outside of the shoe upper located below said flap; and said upwardly extending segment of the upper half of the spring passes up snugly between said strap and the shoe upper.

10. A running shoe according to claim 9, wherein:

said upper half of the spring wire has a pair of laterally spaced arms connected to said lower half of the spring wire at its front end and extending rearward along the side edges of the sole body and then laterally inward into said slot and then rearward beneath the bottom of said upper section of said rear segment of the sole body; and said upwardly extending segment at the rear end of said upper half of the spring wire is a bight which connects and extends laterally between said arms.

11. A running shoe according to claim 10, wherein:

said lower half of the spring wire comprises a pair of laterally spaced arms extending across the top of said lower section of said rear segment of the sole body lengthwise of said slot from back to front and then laterally outward to the side edges of the sole body at its middle segment and then forward along those side edges to a front end located at said middle segment of the sole body, each of said arms of the lower half of the spring wire at its back end extending laterally outward to the nearer side edge of said lower section of said rear segment of the sole body and then rearward and downward across that side edge and then laterally inward into said lower section to anchor the lower half of the spring wire to said lower section of said rear segment of the sole body.

12. In a running shoe having a shoe upper and a sole body of deformable resilient material attached to said upper and having:

a heel-supporting rear segment with top and bottom faces;

an arch-supporting middle segment extending forward from said rear segment; and a ball and toe-supporting front segment extending forward from said middle segment;

said rear segment having a longitudinal slot extending forward from its rear edge between said top and bottom faces across its complete width and separating said rear segment of the sole body into upper and lower sections;

the improvement which comprises:

a spring wire received in said slot and having a lower half attached to said lower section of said rear segment of the sole body and an upper half engaging said upper section of said rear segment of the sole body from below along said slot, said upper half of the spring wire having its front end flexibly and resiliently attached to said lower half of the spring wire and behind its attached front end being free to move up and down toward and away from said lower section of said rear segment of the sole body, said upper and lower halves of the spring body being resiliently biased apart behind said attached front end of said upper half;

said front end of said upper half of the spring wire being attached to said lower half of the spring wire on opposite sides of the sole body forwardly beyond said slot.

13. A running shoe according to claim 12, wherein:

said upper and lower halves of the spring wire resiliently grip the opposite sides of the sole body forwardly beyond said slot.

14. In a running shoe having a shoe upper and a sole body of deformable resilient material attached to said upper and having:

a heel-supporting rear segment with top and bottom faces;

an arch-supporting middle segment extending forward from said rear segment; and a ball and toe-supporting front segment extending forward from said middle segment;

said rear segment having a longitudinal slot extending forward from its rear edge between said top and bottom faces across its complete width and separating said rear segment of the sole body into upper and lower sections;

the improvement which comprises:

a spring wire received in said slot and having a lower half attached to said lower section of said rear segment of the sole body and an upper half engaging said upper section of said rear segment of the sole body from below along said slot. said upper half of the spring wire having its front end flexibly and resiliently attached to said lower half of the spring wire and behind its attached front end being free to move up and down toward and away from said lower section of said rear segment of the sole body, said upper and lower halves of the spring body being resiliently biased apart behind said attached front end of said upper half;

said upper half of the spring wire at its back end extending up behind the shoe upper and being attached to the latter above the back end of said slot;

said lower half of the spring wire at its back end being anchored in said lower section of said rear segment of the sole body;

said front end of said upper half of the spring wire being attached to said lower half of the spring wire on opposite sides of the sole body forwardly beyond said slot; and said upper and lower halves of the spring wire resiliently gripping the opposite sides of the sole body forwardly beyond said slot.

* * * * *

UNITED STATES PATENT AND TRADEMARK OFFICE

CERTIFICATE OF CORRECTION

PATENT NO. : 4,492,046

DATED : January 8, 1985

INVENTOR(S) : Ghenz Kosova

It is certified that error appears in the above-identified patent and that said Letters Patent is hereby corrected as shown below:

On the title page, Item (76) Inventor: should read --Ghenz Kosova, 647 S.W. 17th Court, Boca Raton, Florida 33432--.

Signed and Sealed this

*Thirteenth* Day of *August 1985*

[SEAL]

*Attest:*

DONALD J. QUIGG

*Attesting Officer*

*Acting Commissioner of Patents and Trademarks*